United States Patent [19]
Sims

[11] 3,976,446
[45] Aug. 24, 1976

[54] SULFUR REMOVAL FROM HIGH TEMPERATURE FUEL GAS GENERATED BY GASIFICATION

[75] Inventor: Anker V. Sims, Redondo Beach, Calif.

[73] Assignee: Thermo-Mist Company, Downey, Calif.

[22] Filed: Jan. 22, 1975

[21] Appl. No.: 543,147

[52] U.S. Cl. ..... 55/73; 55/79; 55/80; 165/107
[51] Int. Cl.[2] ..... B01D 53/06
[58] Field of Search ..... 55/73, 79, 80; 165/107

[56] References Cited

UNITED STATES PATENTS

| | | | |
|---|---|---|---|
| 2,432,872 | 12/1947 | Ferro, Jr. | 165/107 X |
| 3,260,035 | 7/1966 | Wheelock et al. | 55/73 |
| 3,283,810 | 11/1966 | Sonnenschein et al. | 165/107 X |
| 3,511,027 | 5/1970 | Roberts et al. | 55/73 X |
| 3,798,309 | 3/1974 | Knowles et al. | 55/73 X |
| 3,831,668 | 8/1974 | Weissenburg | 165/107 |
| 3,839,849 | 10/1974 | Maniya | 55/73 X |

*Primary Examiner*—Thomas G. Wyse
*Assistant Examiner*—Robert H. Spitzer
*Attorney, Agent, or Firm*—Christie, Parker & Hale

[57] ABSTRACT

Hot fuel gas from coal gasification passes countercurrent to cycling heat transfer solids in a tower to lose heat to the solids. The thus cooled fuel gas has sulfur removed and then passes countercurrent in the tower to the now hot solids to cool the solids and reheat the fuel gas. The heated and purified fuel gas is exited from the tower for consumption as in a power plant. The solids are free to flow by gravity but are constricted in the vicinity of the midsection of the tower. This constriction in conjunction with control of gas pressure by monitoring of hot inlet gas pressure and hot but purified fuel gas outlet pressure prevents one or the other of the gases from bypassing the path desired for it.

9 Claims, 1 Drawing Figure

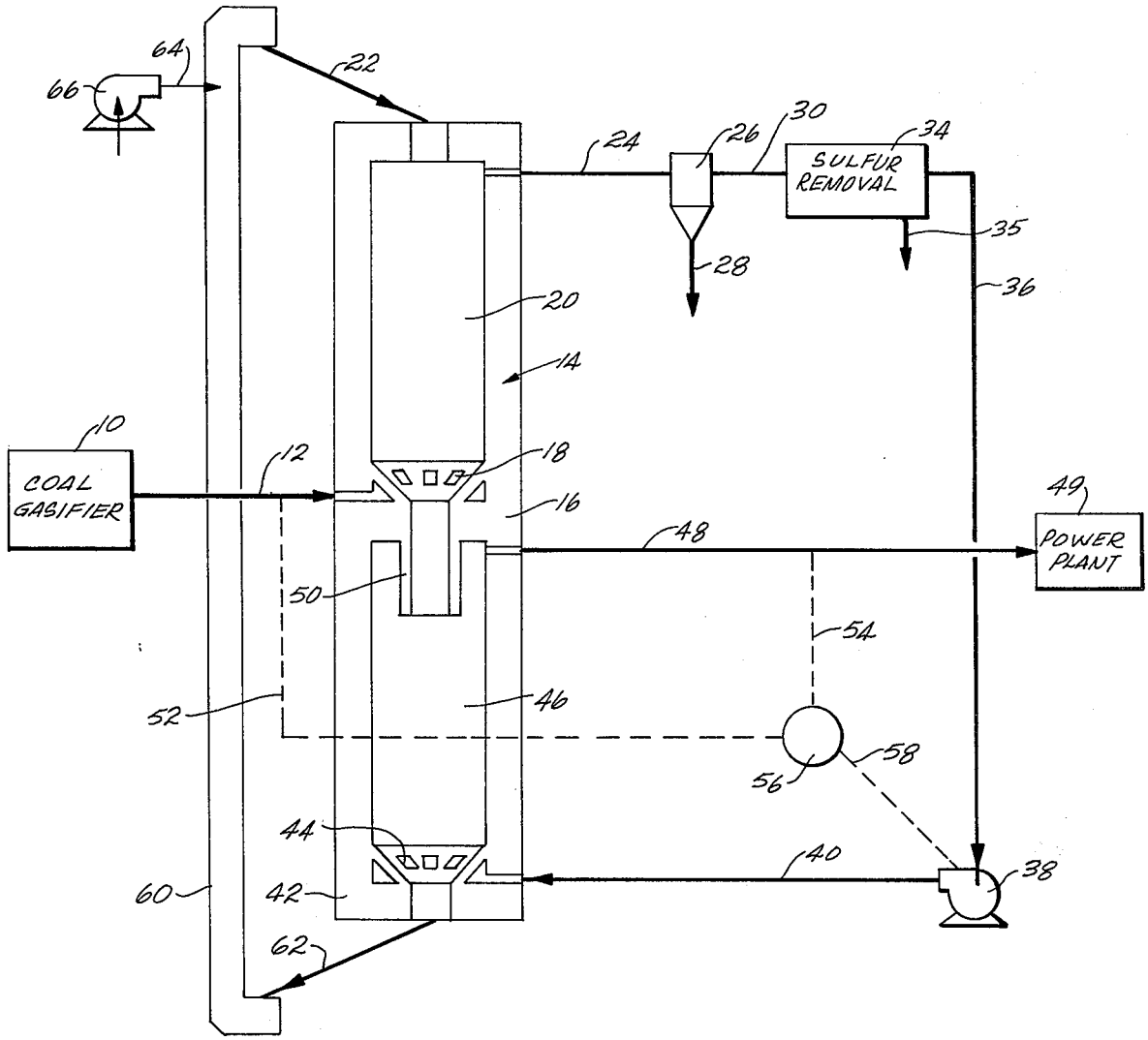
64
66
22
24
26
30
34
SULFUR REMOVAL
35
28
36
20
14
10
COAL GASIFIER
12
18
16
49
POWER PLANT
48
50
54
52
46
58
56
44
40
38
60
42
62

SULFUR REMOVAL FROM HIGH TEMPERATURE FUEL GAS GENERATED BY GASIFICATION

BACKGROUND OF THE INVENTION

The present invention relates to the art of sulfur extraction and more in particular to the art of removing sulfur from a hot fuel gas at low temperatures with high heat recovery and thermal efficiency.

Coal with a high sulfur content is abundant. Regrettably, the sulfur in the coal makes the coal unsuitable as a fuel, for sulfur is an unacceptable pollutant.

The gasification coal to convert it to a gaseous fuel has been explored and is considered highly desirable because the gaseous fuel is more flexible than the solid coal. In either state, however, the fuel value of the coal cannot be used if sulfur it contains cannot be economically reduced to an acceptable level. Existing sulfur removal processes require relatively low temperatures. Thus, it would be necessary in implementing existing processes to cool the hot gases from gasification prior to sulfur removal. A large percentage of the considerable sensible heat of the hot gases lost during cooling must be usefully reclaimed for the process to be attractive.

The present invention is directed to the extraction of sulfur from gasified hydrocarbon values at low temperatures and with a high degree of heat recovery.

SUMMARY OF THE INVENTION

In general the present invention contemplates the treatment of hot gases generated in the gasification of a hydrocarbon such as coal by lowering the temperature of the gases for sulfur removal and then reclaiming the heat lost during cooling to raise the temperature of the fuel gas to a level approaching its original temperature. The reheated and purified fuel gas may then be used as a fuel with a sensible heat approaching the sensible heat it had before sulfur removal.

The heat transfer to cool the hot fuel gas prior to sulfur removal is by direct countercurrent heat exchange with cycling solids and the heat transfer to reclaim the heat in the purified gas is by subsequent heat transfer from the very same solids.

In one form the present invention contemplates a first stage of heat transfer of passing hot fuel gas in countercurrent flow with solids to cool fuel gas and heat the solids. The fuel gas is exited from this heat transfer stage and sulfur is removed from it. The now purified fuel gas, still cold, passes in countercurrent heat transfer with the same solids to which it had previously given up its heat. It picks up the heat from the solids and exits from the second heat transfer stage at a temperature approaching the temperature of the gas entering the process. Thus the purified gas has a sensible heat approaching that of the incoming gas. The heat transfer solids, now cooled, are recycled to the first stage of heat transfer with hot incoming and high sulfur content fuel gas.

The process preferably takes place in a heat transfer tower with a hot fuel gas entering an intermediate or midsection of the tower to ascend in opposition to the flow of descending solids for the first stage of heat transfer. After sulfur extraction, the purified fuel gas is passed back into the tower to flow countercurrent to descending but hot solids to pick up heat from the solids and to cool them. The solids flow through the tower by gravity. In the intermediate section in the vicinity where the hot gases enter the tower, the heat transfer solids pass through a standpipe for solid concentration and the creation of a barrier against gas flow through the standpipe. The pressure of the incoming gas and the pressure of the outgoing purified and hot gas are monitored to control the means which drives the gas, say, a blower, so that the pressure differential between the monitored stream is such that the gases go where desired and do not go along a short circuit path. For example, through the combination of the solid barrier in the standpipe and the control of incoming and outgoing pressures, hot unpurified fuel gas will not channel from the section of the tower responsible for the first stage of heat transfer to the section of the tower responsible for reclaiming the heat in the purified gases.

Features of the present invention include removing particulates from the cold fuel gas in addition to sulfur and of cooling even more the recycled solids during their elevation from the heat transfer stage of solids cooling to the heat transfer stage of the solids heating.

The present invention provides a highly efficient method of reducing the temperature of a hot fuel gas for the removal of sulfur and of reclaiming the heat energy extracted during its cooling to reheat the purified fuel gas. The process is extremely simple, relying on its preferred state on gravity feed of solids through a heat transfer tower and direct countercurrent heat exchange between the fuel gas and the solids.

These and other features, aspects and advantages of the present invention will become more apparent from the following description, appended claims and drawing.

BRIEF DESCRIPTION OF THE FIGURE

The single FIGURE is a flow schematic of the preferred process of the present invention.

DESCRIPTION OF THE PREFERRED EMBODIMENT

In the FIGURE, a coal gasifier 10 produces a stream of hot fuel gas 12. This gas enters a heat transfer tower 14 in a midsection 16. The gas passes around an annulus in the midsection and exits through circumferentially oriented exit ports 18. The gas passes upwardly into a heat transfer section 20 because of pressure. In this section it exchanges heat with solids descending through the section by gravity in direct countercurrent heat transfer contact between the solids and the gas. The solids may be alumina spheres. The solids enter as a stream 22 at the top of heat transfer section 20 for their descent through this section. Cool fuel gas leaves the top of heat transfer section 20 as a stream 24 and enters a unit 26 of standard design for particulate removal as a stream 28. The cold gas stream exits unit 26 as a stream 30 and enters a sulfur removal unit 34, again of standard design, where sulfur is removed to an acceptable level and is taken off as a stream 35. Purified and cold fuel gas leave the sulfur removal unit as a stream 36.

Particulate removal unit 26 may be a bag filter or electrostatic precipitator. Sulfur removal unit 34 may be an amine treater and sulfur plant combination commonly employed in petroleum refineries. Stream 36 feeds the intake of a blower 38. The blower provides the pressure differential between incoming stream 12 and downstream gas for gas flow to the inlet of the blower. A stream 40 leaves the exit of the blower with a slightly greater pressure head and enters a base 42 of the heat transfer tower. In the manner of gas flow into and around intermediate section 16, stream 40 is annulated and exits through ports 44 for ascent upwardly through a second heat transfer section 46. Solids which have picked up heat in heat transfer section 20 flow through intermediate section 16 and into section 46 to pass in direct countercurrent flow with the ascending, purified fuel gas. This time the fuel gas picks up heat from the solids and exits from the top of section 46 as a stream 48. Stream 48 is at a temperature approaching the temperature of stream 12 and is used as a fuel in some desired process, for example, in a power plant 49.

Midsection 16 defines a standpipe 50 for the flow of solids from section 20 to section 46. The standpipe provides a constriction to the descent of solids and this constriction packs the solids somewhat. This packing creates a pressure barrier against the flow of gases between section 20 and section 46. To augment this pressure barrier and to keep the gases flowing along their desired paths, the inlet pressure of stream 12 and the exit pressure of stream 48 are monitored through sensor lines 52 and 54, respectively. The pressure differential between streams 12 and 48 is sensed in a sensor and controller 56. The sensor and controller controls the speed of blower 38, the coupling being indicated by a line 58. By maintaining the pressure difference between the gases in line 12 and the gases in line 48 at substantially zero and in conjunction with the barrier afforded by solids in standpipe 50 in intermediate section 16, gas will not short circuit from one heat transfer section to the other. Accordingly, gas for sulfur and particulate removal will be forced to the units responsible for removal, and purified gas will not be cycled through these units.

Solids pass from heat exchange section 46 to the base of a bucket elevator 60 as a stream 62. Elevator 60 raises the solids for discharge as stream 22. It is impossible in section 46 to reduce the temperature differential between solids in section 46 and incoming purified fuel gas 40 to essentially zero. Because of this, further heat extraction from the solids is necessary external of section 46. This may be accomplished by cooling air entering the elevator as a stream 64 from a blower 66, the feed to the blower being atmospheric air.

EXAMPLE

Assume stream 12 flows at $21.3 \times 10^6$ SCFH (standard cubic feet per hour) and has a fuel value of 375 Btu/SCF, about the fuel requirements for 800 megawatt power plant. Stream 12 enters heat exchange section 20 at a temperature of 1500°F. This gas is cooled in section 20 by descending heat transfer solids and leaves as stream 24 at a temperature of 120°F. The cold gas leaving the top of the tower as stream 24 passes through a bag filter, unit 26, and an amine treater and sulfur plant combination commonly used in petroleum refineries, unit 34. The cold purified gas feeds recycle blower 38 and returns to the bottom of section 46 of heat exchange tower 14 as stream 40. Stream 40 is at 120°F. The gas flows upward through section 46 in contact with hot counterflowing heat transfer solids descending from section 20. Hot, treated gas leaves the tower from the top of section 46 as stream 48 at a temperature of 1490°F and is the fuel feed for power generator 49 of 800 megawatts.

Cold heat transfer solids enter the top of heat exchange section 20 at a temperature of 115°F and flow downward through sections 20 and 46 by gravity. The solids pick up heat from the entering hot gas in section 20 and return the heat to cold gas in section 46. Cold solids leave the bottom of the tower at a temperature of 125°F and are returned to the top of the tower by means of bucket elevator 60. The solids from the bottom of the tower are cooled by air blown through the bucket elevator from blower 66 to a temperature of 115°F.

Gas treating for the removal of contaminants is carried out on low temperature gas. This permits the use of well established commercially proven processes.

Very efficient heat exchange is provided by use of direct contact between the gas and heat transfer solids. The results of the exampled process are shown in the table below and demonstrate that very high heat exchange efficiency can be obtained with a very low expenditure of energy. For the exampled case, a loss of sensible heat over a 100°F base is 0.7% of the incoming heat. The additional energy requirements for elevators and blowers raises the total energy loss to 2.1% of the incoming heat.

Table

| | HP | $10^6$ Btu/Hr |
|---|---|---|
| Sensible heat in incoming gas | — | 570.5 |
| Heat loss (above 100°F) | — | 4.08 |
| Bucket elevators | 282 | 0.72 |
| Recycle blowers | 2388 | 6.08 |
| Cooling air blowers | 400 | 1.02 |
| Total energy lost | | 11.90 |
| or 2.1% of incoming sensible heat | | |

The hot sections of the heat exchange tower are confined to the middle of the tower where there are no moving parts. All gas and solids handling devices operate at low temperatures. The parts of the tower that are in contact with hot gases and solids can be constructed of ceramic materials that are resistant to heat, corrosion, and abrasion. (The "hot" sections being the base of section 20, intermediate section 16 and the top of section 46.) There need be no moving parts in the hot sections.

The present invention has been described with reference to a preferred embodiment. The spirit and scope of the appended claims should not, however, necessarily be limited to this description.

What is claimed is:

1. A process for removing sulfur from hot fuel gas obtained from the gasification of coal with an unacceptably high sulfur content comprising the steps of:

a. continuously passing the hot fuel gas into a midsection of a heat transfer tower;

b. continuously passing the hot fuel gas from the midsection into the base of a fuel gas cooling section of the tower, the cooling section being above the midsection;

c. continuously passing cool solids into the top of the fuel gas cooling section;

d. continuously passing the solids and the fuel gas countercurrent to each other in the fuel gas cooling section and continuously transferring heat from the hot fuel gas to the cool solids in the fuel gas cooling section by direct countercurrent heat transfer to cool the fuel gas and heat the solids;

e. continuously removing the cooled fuel gas from the top of the fuel gas cooling section to separate the gas from the solids;

f. continuously removing sulfur from the removed and cooled fuel gas to form purified and cooled fuel gas;

g. continuously passing the purified and cooled fuel gas into the base of a solids cooling section of the tower, the solids cooling section being below the midsection;

h. continuously passing the heated solids from the base of the fuel gas cooling section into the top of the solids cooling section;

i. continuously passing the solids and the fuel gas countercurrent to each other in the solids cooling section and continuously transferring heat from the heated solids to the purified and cooled fuel gas in the solids cooling section by direct countercurrent heat transfer to cool the solids and heat the purified fuel gas;

j. continuously removing the heated and purified fuel gas from the solids cooling section at the top thereof to separate the heated and purified fuel gas from the solids for use of the heated and purified fuel gas as a fuel; and k. continuously passing the cooled solids from the solids cooling section to the top of the fuel gas cooling section to recycle the solids.

2. The process for removing sulfur claimed in claim 1 wherein:

a. the heated solids are passed from the fuel gas cooling section into the solids cooling section through a standpipe in the midsection for close proximation of the solids and the creation thereby of a barrier for the passage of fuel gas between the fuel gas cooling section and the solids cooling section; and b. the pressures of the hot fuel gas entering the fuel gas cooling section and the pressure of the heated and purified fuel gas at the top of the solids cooling section are maintained substantially equal to cooperate with the solids in the standpipe in preventing the passage of fuel gas between the fuel gas cooling section and the solids cooling section.

3. The process claimed in claim 2 wherein the solids are passed through the fuel gas cooling section, the midsection, and the solids cooling section by gravity.

4. The process for removing sulfur claimed in claim 3 wherein the solids passed from the solids cooling section are additionally cooled.

5. The process for removing sulfur claimed in claim 4 wherein particulates are removed from the cooled fuel gas.

6. A process for removing sulfur from a hot fuel gas stream obtained from the gasification of coal with an unacceptably high sulfur content comprising the steps of:

a. continuously passing the hot fuel gas stream into the midsection of a heat transfer tower;

b. continuously passing the hot fuel gas stream from the midsection into the base of a fuel gas cooling section of the tower and through the fuel gas cooling section by a pressure differential;

c. continuously passing cool solids into the top of the fuel gas cooling section and through the fuel gas cooling section countercurrent to the fuel gas stream therein;

d. continuously transferring heat from the fuel gas stream to the solids in the fuel gas cooling section by direct countercurrent heat transfer to cool the fuel gas and heat the solids;

e. continuously removing the cooled fuel gas from the top of the fuel gas cooling section by a pressure differential as a stream to separate the fuel gas stream from the solids;

f. continuously removing sulfur from the removed and cooled fuel gas stream to form a purified and cooled fuel gas stream;

g. continuously passing the purified and cooled fuel gas stream into the base of a solids cooling section of the tower and through the solids cooling section by a pressure differential, the solids cooling section being below the midsection;

h. continuously passing the heated solids from the base of the fuel gas cooling section through a standpipe in the midsection into the top of the solids cooling section to create a gas barrier in the standpipe by the solids between the fuel gas cooling section and the solids cooling section;

i. continuously transferring heat from the solids to the purified gas stream in the solids cooling section by direct countercurrent heat transfer to cool the solids and heat the purified gas stream;

j. continuously removing the heated and purified fuel gas stream from the top of the solids cooling section by a pressure differential to separate the heated and purified fuel gas stream from the solids for use of the heated and purified fuel gas as a fuel;

k. continuously passing the cooled solids from the solids cooling section to recycle the solids;

l. creating the pressure differentials for the fuel gas streams; and m. maintaining the pressure differential between the hot fuel gas stream entering the fuel gas cooling section and the purified fuel gas stream at the top of the solids cooling section at substantially zero to cooperate with the solids passing through the standpipe to prevent bypassing the hot fuel gas stream into the solids cooling section, such maintenance being by controlling the amount of pressure differential creation.

7. The sulfur removal process claimed in claim 6 wherein the solids are passed through the fuel gas cooling section, the midsection, and the solids cooling section by gravity and the solids are passed between the solids cooling section and the fuel gas cooling section by elevation.

8. The sulfur removal process claimed in claim 7 wherein the solids are additionally cooled during their elevation.

9. The process claimed in claim 8 wherein particulates are removed from the cooled fuel gas prior to the sulfur removal step.

* * * * *